United States Patent [19]

Jass et al.

[11] 3,976,223

[45] Aug. 24, 1976

[54] AEROSOL PACKAGE

[75] Inventors: Herman E. Jass, Princeton; Frederick F. Kohlhepp, Princeton Junction, both of N.J.

[73] Assignee: Carter-Wallace, Inc., New York, N.Y.

[22] Filed: June 26, 1975

[21] Appl. No.: 590,553

Related U.S. Application Data

[63] Continuation of Ser. No. 22,729, Feb. 2, 1972, abandoned.

[52] U.S. Cl. ..... 222/94; 222/95

[51] Int. Cl.[2] ..... B65D 35/22; B65D 35/28

[58] Field of Search ..... 222/94, 95, 136, 137, 222/387, 389; 239/307

[56] References Cited

UNITED STATES PATENTS

| | | | |
|---|---|---|---|
| 3,335,913 | 8/1967 | Bouet | 222/95 |
| 3,401,844 | 9/1968 | Hanson | 239/307 X |
| 3,675,821 | 7/1972 | Morane | 222/389 X |

*Primary Examiner*—Allen N. Knowles
*Assistant Examiner*—Hadd Lane
*Attorney, Agent, or Firm*—Wenderoth, Lind & Ponack

[57] ABSTRACT

A valve-actuated aerosol package for separately storing and simultaneously dispensing in the form of a spray or stream a plurality of flowable materials. The package comprising a self-standing first container closed at one end with a dispensing valve at its opposite end and forming a first chamber. A piston diaphragm pressurably mated with the inner walls of the first chamber and dividing said chamber into an upper and lower chamber, a second coaxially mounted container within said upper chamber such that liquid cannot pass between said second container and said upper chamber. The valve-actuated aerosol package being operative to dispense flowable materials from said upper chamber and said second container separately and simultaneously or as a mixture through a dispensing nozzle.

3 Claims, 3 Drawing Figures

AEROSOL PACKAGE

This is a continuation of application Ser. No. 22,729, filed Feb. 2. 1972, now abandoned.

BACKGROUND OF THE INVENTION

This invention relates to a package for storing and dispensing a plurality of flowable substances and, more particularly, to such a package wherein the flowable substances are segregated during storage and dispensed either as a mixture or separately.

Many millions of aerosol packages containing flowable materials are manufactured and sold annually. The most common of the substances or materials packaged in fluid valve-actuated pressure containers and dispensed through such valves are those materials which can be premixed and stored. Thus, the materials have been premixed, packaged under pressure in a single compartment aerosol package and such mixtures of materials are dispensed from the aerosol package in admixture with the propellant gas. This latter aspect can also be detrimental when low foam products are desired.

However, other desirable materials when mixed together react and have beneficial effects provided they are used within relatively short time periods before loss of efficacy, i.e. through decomposition or deterioration, has occurred.

The typical examples of materials which react when mixed and, because of such reaction, must be kept separated from each other until used are oxidants and reductants for controlled heat release with "hot" shaving foams, dyes and developers for hair colorings, epoxy resin based paints and cements which harden upon mixing with a hardening agent and compounds which are desired for their ability to release materials such as oxygen, i.e. toothpastes and peroxide compounds, which, if premixed and stored, tend to lose their desired properties through decomposition of the peroxide with the added danger of increased pressure build-up in the package in addition to loss of efficacy of the mixture. Further, it is also often advantageous in order to protect the user and/or the products flavor, texture or performance to be sure that the propellant does not contact or become admixed with the product.

Prior to the present invention various attempts have been made to provide an aerosol package in which materials may be stored separately under pressure and the stored materials dispensed under pressure as a stream or spray. These prior art aerosol packages, while effectively separating product from propellant, do not provide for the storage of a plurality of products which can be dispensed under pressure simultaneously as separate streams or sprays or admixed and dispensed as a single stream or spray. Further, among the difficulties encountered by the prior art has been the inability to provide reliable efficient discharge of properly related amounts of materials from the separate storage or product compartment. Usually the product compartment tends to contract non-uniformly as its contents are discharged, thus allowing improper proportions of materials to be discharged and/or incomplete discharge of all the material from the container.

SUMMARY OF THE INVENTION

In order to overcome the aforesaid difficulties, the present invention provides an aerosol package for separately packaging and storing a plurality of flowable substances such as dyes and developers, toothpastes and peroxides, epoxy resins and hardners, etc., in a single package from which such materials may be dispensed as separate streams or sprays or they may be admixed and dispensed as a single stream or spray. Moreover, the packages of the present invention allow the storing and dispensing of viscous materials, at predetermined proportions, which are free of propellant gases. These and other aspects of the present invention are accomplished by utilizing the lower portion of the outer container body as a pressure tight storage chamber for the propellant gas while the upper portion of the outer container body serves as a storage chamber for one of the flowable materials or substances and by providing in such chamber one or more separate containers, coaxial with the outer container body as storage chambers for the flowable materials to be stored separately from, but dispensed with, the flowable material stored in the upper chamber of the outer container body. The container or containers coaxial in the upper chamber of the outer container body are of a pliable, flexible substance and of such configuration that they collapse readily and uniformly as the materials are dispensed thus permitting the materials in said containers to be dispensed uniformly and completely when the dispensing valve is actuated.

DETAILED DESCRIPTION

The outer container body of the aerosol package of the present invention is divided by means of a piston, which will be described hereafter in detail, pressurably mated with the inner walls of the outer container so as to divide the outer container into an upper and lower chamber. The outer container is of rigid or semi-rigid material of sufficient strength to withstand loading the storage pressures. The lower end of the container is closed but is provided with a self-sealing plug which permits charging of the propellant into the lower chamber. The upper end is also closed but is provided with a dispensing valve which, when actuated, allows the materials, stored in the upper chamber of the container under pressure, to be dispensed in a spray or stream. The inner container extends coaxially in the upper chamber of the outer container and is attached at its upper end to the dispensing valve, as will be described in more detail. The axially extending walls of the inner container are corrugated or accordion pleated and the lower end of the inner container nests in a recess of the pressurably mated sleeved piston in the lower end of the upper chamber of the outer container. The lower chamber of the outer container, which is pressure tight with respect to the upper chamber of the outer container, is pressurized with a gas through a self-sealing plug in the container bottom. When the dispensing valve is opened, as will be described, the pressurized gas in the lower pressure sealed chamber causes the piston to move away from the container bottom and toward the dispensing valve end of the container. As the piston moves, the flowable materials in the upper chamber of the outer container and inner container are dispensed in a stream through the actuator on the opened dispensing valve. The spray form is achieved by embodying mechanical stream breakup features into the valve and actuator by methods well known to those skilled in the art.

The instant invention will be more fully understood from the following description and attached drawings of an illustrated embodiment of the invention in which.

Figure 1:
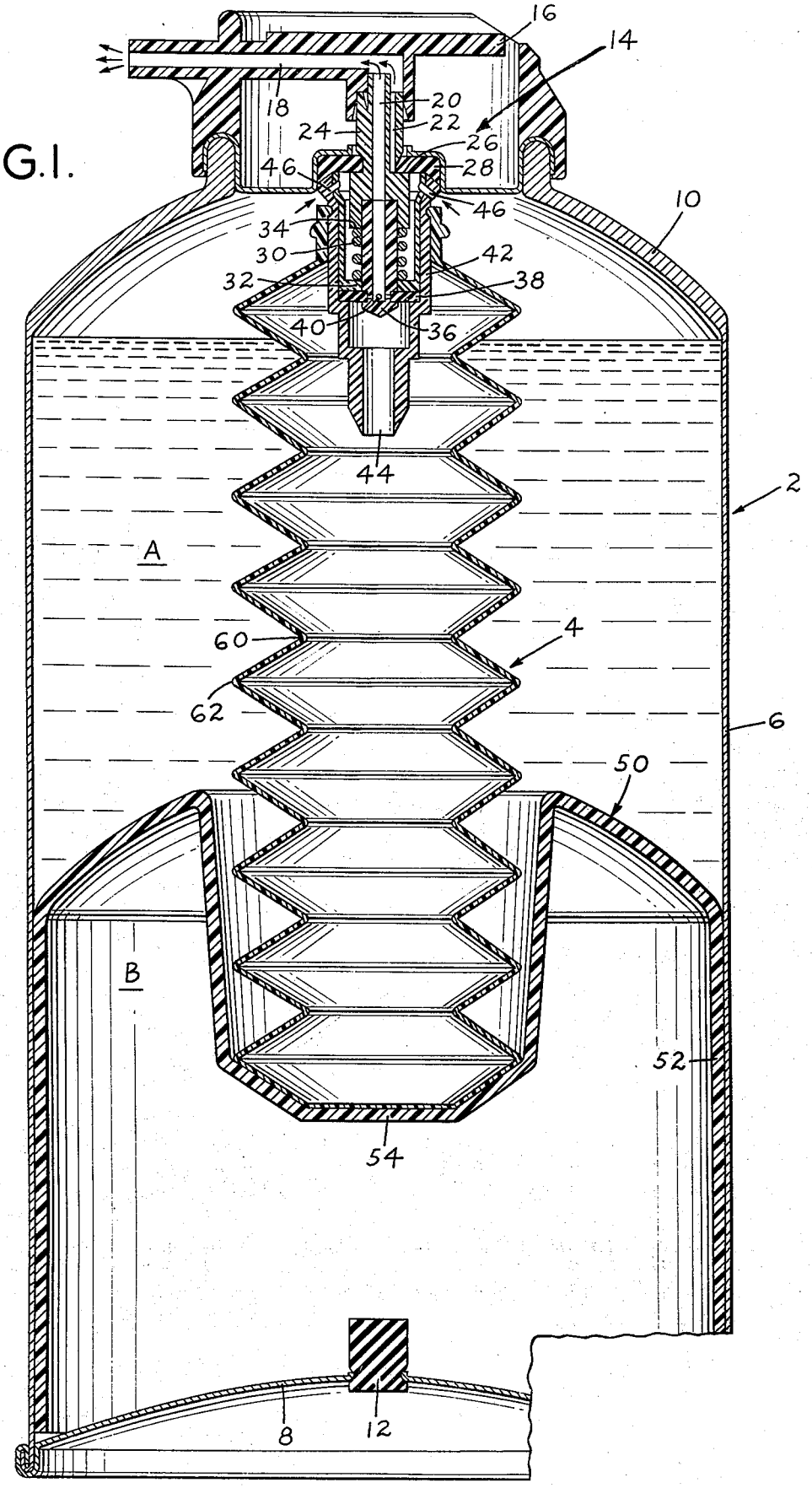
FIG. 1 is a side elevational view, in section, of the aerosol package of the instant invention showing the dispensing valve closed.

Referring to the drawings, the illustrated embodiment of the instant invention includes an outer container, generally designated 2, and an inner container, generally designated 4. Outer container 2 has a cylindrical body 6, a bottom 8 and a top 10. Bottom 8 and top 10 are joined to body 6 in conventional manner to form a pressure tight chamber for purposes hereinafter more apparent. Plug 12 of resilient, self-sealing material, such as rubber, is mounted in bottom 8 for purpose hereinafter described. The dispensing valve assembly, generally designated 14, is press fitted, in conventional manner, in top 10 and forms a pressure tight closure when the valve is closed. Dispensing valve 14 may be of a construction conventional for use in pressure dispensers, for example aerosol dispensers, so long as valve assembly is provided with suitable outlets and passageways, as will be later described.

In the dispensing valve illustrated, valve actuator 16 has passageway 18 connected to passageways 20, 22, in stem 24. Shoulder 26 on stem 24 is held in fluid tight contact with resilient set 28, when the valve is closed, preventing the flowable material, under pressure in outer container 2, from escaping into passgeway 22, by compression spring 30. Compression spring 30 is seated, at one of its ends, against valve housing sleeve 32, and, at its opposite end, against shoulder 34 on stem 24. Stem cap 36, at the lower end of valve 24, is held by compression spring 30, when the dispensing valve is closed, in fluid tight engagement with resilient seat 38, preventing the flowable material, under pressure in inner chamber 4, from escaping into pasageway 20 through ports 40 at cap end 36 of stem 24. Valve housing 42 opens at its lower end 44 into inner container 4 and, at its upper end is provided with ports 46, connecting outer container 2 with the interior of valve housing 42 for purpose later more apparent.

Cylindrical body 6 and bottom 8 may be of any material sufficiently rigid and non-porous and of sufficient strength to contain the flowable material under pressure provided the container body is free of side seams so as to premit a pressure tight seal between the container sides and piston 50. Sheet metal, of the type commonly used in aerosol containers, is suitable as the materials for body 6 and bottom 8, as well as top 10.

In the aerosol package of the instant application, the chamber formed by outer container 2 is divided into two chambers, A and B, by piston 50, having a downwardly extending skirt 52 and a centrally located recess or boss 54. Piston 50 may be of any material inert to the materials to be used in the dispenser and sufficiently flexible and resilient to form a pressure tight seal between the inner wall of cylindrical body 2 and the outer wall of skirt 52.

Inner container 4 is closed at its bottom end and is seated within recess or boss 54 of piston 50. At its upper end, the inner container 4 is open but fits snugly onto valve housing 42 so that, when the dispensing valve is closed, the flowable material is held, under pressure, in inner container 4.

Inner container 4 is fabricated from a semi-rigid material and may be of any configuration so long as uniform collapse and axial alignment is maintained as piston 50 moves away from bottom 8 toward top 10. In the preferred embodiment container 4 is accordion pleated, at 60, 62, so that, as piston 50 is moved away from bottom 8 toward top 10 the accordion pleats 60, 62 in inner container 4 will fold or collapse while inner container 4 remains axially aligned between recess 54 in piston 50 and dispensing valve 14.

Chamber A of outer container 2 and inner container 4 are charged, in conventional manner, with the flowable materials to be dispensed. The flowable material to be dispensed proportionally in the larger volume on each valve activation is, of course, charged into the larger container or chamber and the flowable material to be dispensed in the smaller volume is charged into the smaller chamber or container, as the case may be. Ports 40, 46 are proportioned to assure proper metered dispensing of the respective flowable materials. After chamber A of outer container 2 and inner container 4 have been charged, chamber B is charged with a gas, under pressure, by for example, inserting a charging needle through plug 12. When the charging needle is withdrawn, plug 12 self-seals.

Figure 2:
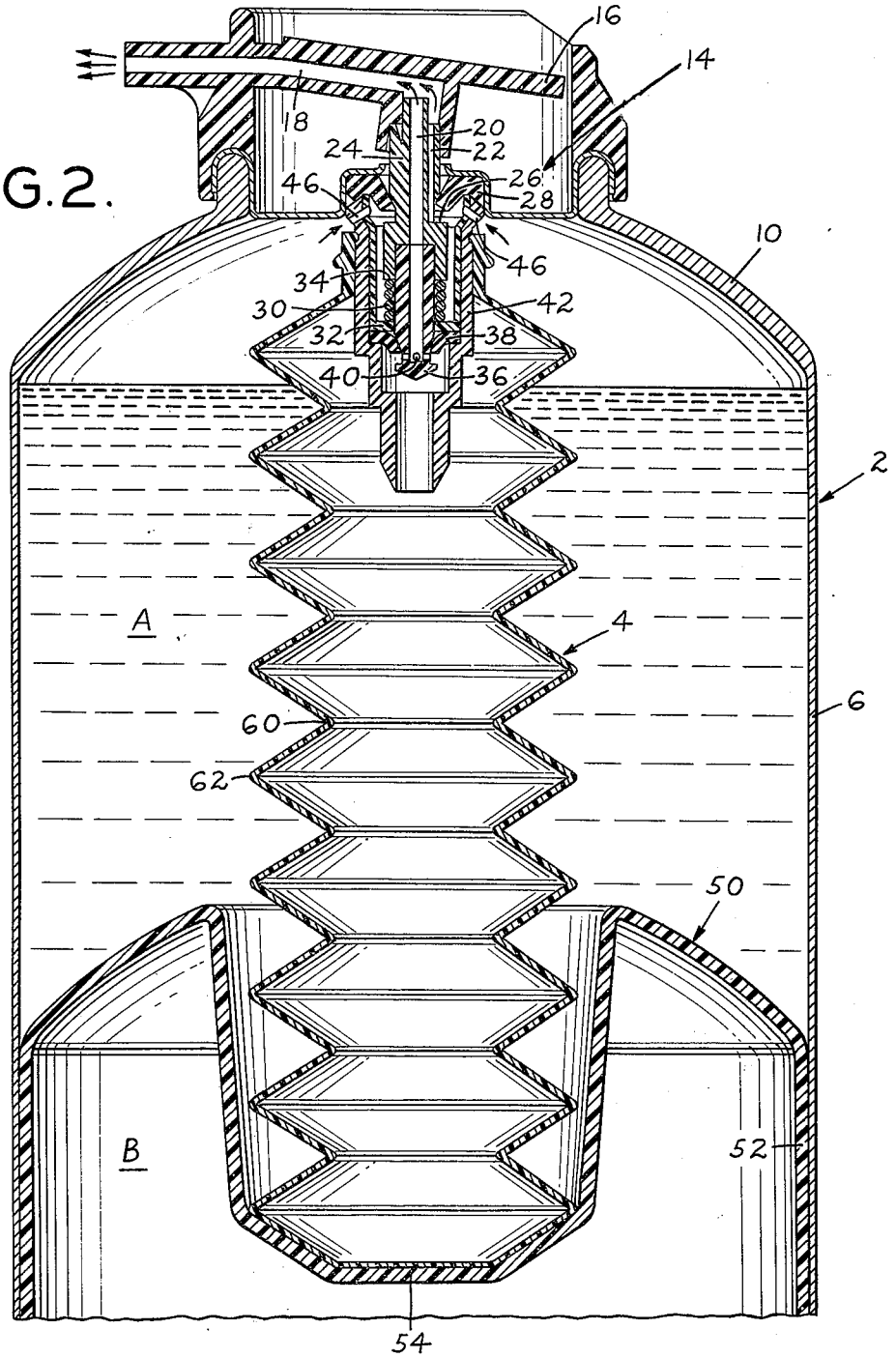
FIG. 2 is a view similar to FIG. 1 but showing the dispensing valve in an open or actuated position.

As best shown in FIGS. 1 and 2, in operation of this embodiment, the flowable materials to be dispensed intermix in passageway 18 and the intermixture is discharged from the end of such passageway. In order that this might be accomplished, valve actuator 16 is depressed, as for example with the finger tip. Spring 30 is compressed and shoulder 26 of stem 24 and stem cap 36 are forced off of resilient seats 28, 38, respectively. Thus, ports 40, 46 are opened and the flowable material is dispensed through passageways 20, 22 into passageway 18. As valve actuator 16 is depressed and ports 40, 46 are opened, the gas under pressure in pressure tight chamber B forces piston 50 away from closed end 8 toward dispensing valve 14. The gas, under pressure in chamber B, forces skirt 52 of piston 50 into engagement with the inner wall of cylindrical body 6 assuring a pressure tight seal between chambers A and B.

With valve actuator 16 depressed and shoulder 26 and stem cap 36 open and off of resilient seats 28, 38 piston 50, as it moves toward dispensng valve 14, forces a uniform, metered amount of the flowable material out of Chamber A as a stream or spray through passageway 18. At the same time, piston 50 collapses or folds pleats 60, 62 in inner container 4 and forces a uniform, metered amount of the flowable material in inner container 4 out of the container as a stream or spray. Thus uniform, metered amounts of the flowable materials are discharged and intermixed in passageway 18 and the mixture is discharged from the end of passageway 18. As pleats 60, 62 in inner container 4 collapse or fold, the collapsed or folded container 4 is nested in recess or boss 54 of piston 50. This nesting of collapsed or folded container in recess or boss 54 assures uniform and complete dispensing of the flowable material from inner container 4 when the dispensing valve 14 is actuated and prevents misalignment of inner container 4 and resultant cut-off of flow therefrom. Because the displacement in the outer and inner containers is constant throughout the life of the dispenser of the instant invention, the relative metering or proportioning of the flowable materials from the containers remains constant.

Figure 3:
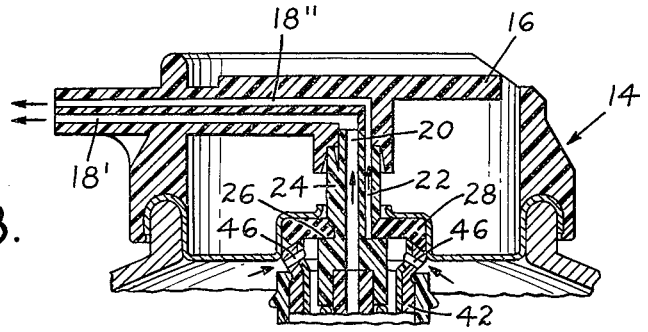
FIG. 3 is a side elevational view, in section, of a modification of the actuator of FIGS. 1 and 2.

Referring to FIG. 3, the embodiment illustrated therein is identical to the embodiment of FIGS. 1 and 2 except that, in the embodiment of FIG. 3, the flowable materials dispensed from the inner and outer containers are discharged as separate sprays or streams. Thus, when dispensing valve 16 is actuated, the flowable material from Chamber A is discharged through passageway 22 into passageway 18'' and the flowable material from inner container 4 is discharged through passageway 20 into passageway 18'. The flowable materials discharged from passageways 18', 18'' may be directed so that the streams or spray intermix after discharge or intermix upon contact with the object to which such streams or sprays are directed. The discharged arrangement in an intermixed single stream or spray, as in FIGS. 1 and 2 or as separated streams or sprays, as in FIG. 3, intermixed after discharge or upon contact will, of course, depend upon the flowable materials, their interaction and the results desired.

The aerosol packages of the present invention are particularly useful and preferred over existing prior art containers in those applications where it is desired to simultaneously dispense a plurality of separately stored materials from a single container wherein the materials are free of propellant gas. Separation of the propellant may be desired to prevent foaming, dilution or liquefaction of the dispersed product and further prevents contamination of propellant with subsequent concern of toxicity.

With regard to such applications, the aerosol containers of the present invention have been found to be useful in the treatment of periodontal disorders or conditions. Specifically, aerosol containers have been utilized in dispensing oxygen containing aerosol products useful in the treatment of periodontal disorders or conditions. As used herein the term "periodontal disorders or conditions" includes disorders involving the oral cavity generally, as well as the teeth and their supporting and covering tissue.

It is a well-known method of treatment for gingivities and periodontal disorders generally to apply to the gingiva and massage hydrogen peroxide solutions or pastes or solutions of pastes containing active oxygen or hydrogen peroxide liberating ingredients such as the peroxides, percarbonates and perborates of the alkali and alkaline earth metals. The rationale for this treatment is that the disorders are believed to be caused by infectious anaerobic microorganisms which are active in the absence of oxygen. The anaerobic microorganisms can be controlled or eliminated entirely by the application of compounds containing active oxygen or peroxy compounds which will readily release oxygen. The presence of oxygen creates an aerobic atmosphere which is antagonistic to the anaerobic mocroorganisms.

Pastes and powders containing active oxygen or hydrogen peroxide liberating ingredients such as peroxides percarbonates and perborates of the alkali and alkaline earth metals or complex compounds containing hydrogen peroxide with salts of the alkali or alkaline earth metals have been known and used for some time. However, the products previously available have been found to suffer from several serious drawbacks, specifically, combinations of peroxide and toothpaste have not been available since these products tend to decompose within a relatively short period of time following manufacture with concomitant loss of all or a substantial amount of the available oxygen. The peroxy compounds are notoriously unstable and have been found to be difficult to formulate into aqueous solutions or pastes which will have a good shelf-life and yet will readily liberate oxygen when applied to the oral cavity. Therefore, prior to the present invention oxygen liberating compositions for the treatment of periodontal disorders or conditions have usually been formulated as anhydrous powders or water-free pastes, ointments, etc., which must be zealously guarded against contamination. Additionally, these formulations have been found difficult or inconvenient to use since dosage cannot be easily regulated.

It has also been proposed to employ hydrogen peroxide solutions in the prophylaxis and therapy of periodontal disorders and conditions; however, these solutions have been found to be too fluid to permit effective massaging of the solution on the infected area of the gingiva. Further, hydrogen peroxide solutions, due to their extreme evanescent qualities tend to provide no more than transient aerobic conditions in the oral cavity.

The aerosol package of the present invention provides a means whereby a stable source of oxygen is provided at the oral cavity for the treatment of periodontal disorders and conditions, which source is protected from contamination and which, when applied to the gingiva, readily releases nascent oxygen. The aerosol packages of the present invention which achieve these desired results are pressure dispensed compositions in which peroxide solutions in gel or emulsion form and suitable vehicles are stored separately within an aerosol package in which preferably both the peroxide solution and toothpaste vehicle are separated from the propellant. The vehicle and peroxide solution, upon actuation of the external valve are released through the orifice connected to their respective storage chambers to a mixing chamber in the valve and subsequently dispersed as an essentially homogeneous mixture or solutions.

The toothpaste vehicle employed in the present invention for use in combination with the peroxide solution can be any pharmacologically acceptable fluid material, including gels, which can be dispensed through the aerosol valve. The toothpastes employed generally comprise one or more of the following: (a) an abrasive or polishing agent to assist in the removal of plaque from the teeth as well as to polish tooth surfaces so as to prevent the adhesion of plaque thereto. Typical cleaning and polishing agents employed are aluminum hydroxide, dicalcium phosphate dihydrate, hydrated alumina, silia aerogels, calcium pyrophosphate, insoluble sodium metaphosphate, chalk, etc.; (b) a detergent or surfactant to act as an emulsifier of lipids, etc.; and (c) a desensitizer such as strontium chloride or formaldehyde for sensitive dentin which is usually associated with periodontal disorders. Additionally, the toothpaste compositions also contain humectants such as glycerine and polyethylene glycol, binders such as carboxy methylcellulose and natural gums, preservatives such as benzoic acid and sweetners such as saccharin.

Table 1, which follows, contains a listing of typical fluid vehicles which may by employed in the present invention.

TABLE I

| | | I | II | III | RANGE |
|---|---|---|---|---|---|
| (a) | Dicalcium Phosphate, Dihydrate | 43.00 | 43.00 | 43.00 | 20–60% |
| | Dicalcium Phosphate, Anhydrous | 6.00 | 6.00 | 6.00 | 2–20% |
| (b) | Sodium Carragheenate | 1.00 | 1.00 | — | 0.5–2 % |
| | Carboxymethyl Cellulose, Hercules CMC — 12 MV | — | — | 1.50 | |
| (c) | Glycerine | 28.00 | 24.00 | 14.00 | |
| | Polyethylene Glycol 400 | — | 4.00 | — | 10–40% |
| | Sorbitol 70% | — | — | 20.00 | |
| | Benzoic Acid | 0.05 | 0.05 | 0.05 | |
| (d) | Sodium Lauryl Sulfate | 1.00 | 1.00 | 1.00 | 0.5–3 % |
| (e) | Flavor | 1.00 | 1.00 | 1.00 | |
| | Saccharin | 0.15 | 0.15 | 0.15 | |
| | Deionized Water | 19.80 | 19.80 | 13.30 | |
| | | 100.00 | 100.00 | 100.00 | |

The peroxide component is in the form of an inert gel of such viscosity that it readily emanates from the dispensing valve with the toothpaste as a single ribbon and when the peroxide concentration remains reasonably constant. A total peroxide concentration of between 0.5 and 3.5 percent by weight of the total dentifrice composition as applied to the oral cavity is desired.

The peroxide component of the peroxide solutions useful in the present invention are available in the art and are exemplified by urea peroxide and hydrogen peroxide. Solvents useful in preparing the peroxide solutions of the present invention are propylene glycol and mineral oil.

A further component of the peroxide solution of the present invention is a gelling or thickening agent such as CARBOPOL, a registered trademark of B. F. Goodrich Co., silicia aerogels and xerogels.

Table II, which follows, contains a listing of typical peroxide solutions which have been found suitable for use in the present invention.

TABLE II

| | Peroxide Gels I | II | III | RANGE |
|---|---|---|---|---|
| Silica Xerogel (Sylord 244) | — | — | 2.0 | |
| Cal-O-Sil M-5 (Silica Aerogel) | — | 6.0 | 4.0 | |
| Carbopol 940 | 3.0 | — | — | 1–10% |
| Triethanolamin 99% | 4.0 | — | — | |
| Tween 60 | — | 1.0 | 1.0 | 0.1–5 % |
| Hydrogen Peroxide (35%) | 28.5 | 28.5 | 28.5 | 15–45% |
| Deionized Water | 64.5 | 64.5 | 64.5 | |
| | 100.0 | 100.0 | 100.0 | |

Suitable propellants in amounts of from 1 to 10 percent by weight of the total weight of separately stored components of the dentifrice composition are used in pressurizing the aerosol packages of the present invention. Suitable propellants include the condensable gaseous propellants ordinarily used in the manufacture of aerosol compositions. For example, suitable propellants include the hydrocarbon propellants, such as propane, butane, isobutane and isopentane. Additionally, the halogenated hydrocarbons such as monochlorotrifluoromethane, dichlorodifluoromethane, trichloromonofluoromethane, etc., may be used.

EXAMPLE A

Oxygenated Toothpaste

| I | PEROXIDE GEL COMPOSITION Ingredient | Weight % |
|---|---|---|
| | Carbopol 940 | 3.0 |
| | Albone CG (35% peroxide) | 28.5 |
| | Triethanolamine | 3.0 |
| | Deionized water | 65.5 |
| II | TOOTHPASTE VEHICLE COMPOSITION | |

EXAMPLE A-continued

| | Ingredient | Weight % |
|---|---|---|
| | Dicalcium Phosphate dihydrate | 43.00 |
| | Dicalcium Phosphate anhydrous | 6.00 |
| | Viscarin TP-4 | 1.75 |
| | Glycerin | 19.00 |
| | Saccharin | 0.15 |
| | Benzoic Acid | 0.05 |
| | Sodium Lauryl Sulfate (99%) | 1.00 |
| | Flavor Oils | 1.00 |
| | Deionized Water | 28.05 |
| III | PROPELLANT Ingredient | Weight % |
| | Dichlorodifluoromethane | 57.0 |
| | Tetrafluorodichloroethane | 43.0 |

The peroxide gel composition I which is mixed in a conventional manner may be present in the final composition in an amount of from about 10 to 60 percent by weight of the total oxygenated toothpaste composition. In the present example, the peroxide gel comprised 30 percent by weight of the total composition including propellant.

Likewise, the toothpaste vehicle composition II is prepared by well-known methods and can be incorporated into the total composition in amounts ranging from about 30 to 85 percent by weight. In the present example 62 percent by weight of the toothpaste vehicle composition is present in the aerosol packages of the present invention. The propellant III is present in an amount of from about 1 percent to about 15 percent by weight of the total composition in the case of liquified gases and from about 5 percent to about 50 percent by weight in the case of compressed gases. In this example 8 percent by weight, based on the total composition of propellant was incorporated into the aerosol package.

The peroxide composition and the toothpaste vehicle are filled into inner container 4 and chamber A, respectively, of the aerosol package of the present invention by hand pouring or spooning the material directly into the appropriate receptacle with care being taken not to damage the semi-rigid material from which the inner container is fabricated. Additional care should be taken to see that no air is entrapped in the packed chambers so as to avoid erratic discharge of the oxygenated toothpaste composition. The inner container is attached snugly to the valve housing as indicated in the drawings. The valve is crimped on in a normal manner with standard crimping equipment.

The propellant can be loaded into the lower chamber B of the outer container body by manual insertion of a hypodermic needle or by typical aerosol burette through the self-sealing valve or plug 12. Needle penetration should be at least about inch in order to clear the gassing valve or plug; however, excessive penetration is to be guarded against in order to avoid piercing or otherwise damaging the piston or skirt.

A further application of the novel aerosol packages of the present invention involves the application of a strippable bandage having the following desirable characteristics.

The accepted method for treatment of second and third degree burns is to provide a cover over the burned area of flesh and exclude air, a pain producing agent in this case, from the burned area. Traditionally gauze bandages and/or petrolatum base salves have been applied over the burned area of the body. Both of these procedures suffer from serious drawbacks. The application of salves is unacceptable because before the patient can receive additional medical treatment, the salve must be removed. This procedure often results in inducing traumatic shock. The gauze bandage, while being a prescribed treatment of long standing, also suffers from a serious drawback. Specifically, the gauze bandage is apt to become soaked with serum emitting from the burned flesh and when this material dries in the gauze bandage, the bandage proves difficult and painful to remove.

It has been found that by employing the novel aerosol package of the present invention a soothing strippable gel bandage with or without medicaments and comprising sodium or potassium alginates as well as alginic acid, can be readily gelled by the addition of calcium ions into the alginate and/or alginic acid solution at the site of use.

A preferred composition of the present invention is prepared by separately storing 2 percent aqueous solution of potassium or sodium alginate or of alginic acid in chamber A of the aerosol package illustrated in the drawings and a 4 percent aqueous solution of calcium chloride in inner container 4 by regulating such variables as pressure spray pattern, etc., a spray bandage can be obtained which ranges from a spongy gel to a thin film.

A burn bandage useful in the aerosol system of the present invention is set out in Example B, as follows:

EXAMPLE B

Spray Bandage

PHASE I

| Ingredient | Parts by Weight |
|---|---|
| Alginic acid salt of an alkali metal (e.g. $Na^+$ or $K^+$) | 1.00–3.00 |
| Preservative (methylparaben USP) | 0.05–0.15 |
| Non-ionic surfactant (e.g. sorbitan derivatives of the Tween type) | 0.10–0.50 |
| Chelating agent, e.g. sodium pyrophosphate, trisodium phosphate, sodium hexametaphosphate | 0.075–0.25 |

EXAMPLE B-continued

| | |
|---|---|
| Distilled water | Balance |

PHASE II

| Ingredient | Parts by Weight |
|---|---|
| Calcium salt (preferably water-soluble, e.g. calcium chloride) | 3.0–5.0 |
| Viscosity regulator (non-ionic polymer, e.g. GELAMIDE 250) | 0.1–1.0 |
| Preservative (methylparaben USP) | 0.05–0.15 |
| Distilled water | Balance |

It is obvious to those skilled in the art that antibacterials, germicides, local anesthetics, etc., can readily be added to either of both phases to further enhance the benefits obtainable from the above formulations. One hundred grams of each phase was charged into the inner container 4 and chamber A, respectively, crimped and charged in accordance with the procedure set forth in Example A. When sprayed, a water-soluble, strippable gel-like covering suitable for use on burns is obtained. The reactivity of Phase II necessitates dispensing the components separately through a dual orifice actuator since allowing the mixing to proceed inside the actuator would cause clogging and render the unit inoperable.

Although described herein in terms of its utility in the administration of dentifrice compositions and the application of strippable bendage, it is apparent that the aerosol container of the present invention can be used otherwise. For example the container is useful for storing and dispensing hot shaving lathers, hair dyes and bleaches, food products and the like.

What is claimed is:

1. A dispenser for separately storing and simultaneously dispensing a plurality of flowable materials, said dispenser comprising:

an outer container body closed at one end and having a dispensing valve means at its opposite end;

piston means in said outer container body intermediate said ends and defining in said container body an axially extending inner pressure tight upper chamber for a first flowable material, and an axially extending inner pressure tight lower chamber for a fluid material;

at least one collapsible inner container body for a second flowable material in said upper chamber co-axial therewith, said inner container having a diameter substantially less than the inside diameter of the outer container body and having walls which are transversely accordion pleated and being integrally closed at its end adjacent to the closed end of said outer container body and connected at its opposite end to said dispensing valve means;

said piston means in said outer container body being movable in said upper and lower chambers for dispensing flowable materials out of said upper chamber and said inner container body through said dispensing valve means, said piston means comprising a piston having a skirt extending axially along the inner surface of the wall of said outer container body and having a recess in the face thereof which is toward said valve means in which recess the closed end of said inner container is seated for guiding said inner container body as it collapses as said piston means moves from said closed end of said outer container body towards said dispensing valve means, said recess being sufficiently deep for accomodating a substantial portion of said inner container when collapsed to prevent misalignment of said inner container during its collapse, and constituting the sole means for guiding said container during its collapse.

2. A dispenser, as recited in claim 1, in which said dispensing valve includes a single connecting passageway into which said flowable materials are discharged and intermixed before said flowable materials are dispensed from said dispenser.

3. A dispenser, as recited in claim 1, in which said dispensing valve includes a plurality of passageways and said flowable materials are separately dispensed from said dispenser through individual of said plurality of passageways.

* * * * *